US005724690A

United States Patent [19]

Babuin et al.

[11] Patent Number: 5,724,690

[45] Date of Patent: Mar. 10, 1998

[54] CLOTHES WASHING MACHINE WITH WATER RECOVERY RESERVOIR AND IMPROVED WASHING CYCLE

[75] Inventors: Piero Babuin, Pordenone; Silvano Cimetta, Treviso, both of Italy

[73] Assignee: Electrolux Zapussi Electrodomestici S.p.A., Pordenone, Italy

[21] Appl. No.: 608,254

[22] Filed: Feb. 28, 1996

[30] Foreign Application Priority Data

Mar. 7, 1995 [IT] Italy ..... PN95A0015

[51] Int. Cl.[6] ..... D06F 39/08

[52] U.S. Cl. ..... 8/158; 68/207; 68/208; 68/902

[58] Field of Search ..... 8/158; 68/902, 68/18 R, 207, 208

[56] References Cited

U.S. PATENT DOCUMENTS

| | | | |
|---|---|---|---|
| 2,588,774 | 3/1952 | Smith | 68/902 X |
| 2,931,199 | 4/1960 | Steffey . | |
| 5,285,665 | 2/1994 | Hetrick, Jr. | 68/902 X |

FOREIGN PATENT DOCUMENTS

| | | | |
|---|---|---|---|
| 449060 | 10/1991 | European Pat. Off. . | |
| 2359235 | 2/1978 | France | 8/158 |
| 2287961 | 10/1995 | United Kingdom . | |

*Primary Examiner*—Philip R. Coe
*Attorney, Agent, or Firm*—Pearne, Gordon, McCoy & Granger LLP

[57] ABSTRACT

A clothes washing machine includes a washing tub, a drum rotatably arranged within the tub and adapted to hold the washload, and a liquor recovery reservoir, separable from the structure of the machine. A liquor transfer conduit connects the lower portion of the washing tub with the inner volume of the reservoir, preferably through a first pump situated in the conduit. A second conduit connects the inner volume of the reservoir with the inner volume of the washing tub through a second pump. As a part of a rinsing phase, the machine is adapted to the rinsing liquor from the tub to the reservoir, spin the washload holding drum at a high revolution speed, empty the tub by draining the liquor extracted from the washload during the high-speed spinning of the drum or subsequently thereto, and transfer the liquor contained in the reservoir back into the tub.

15 Claims, 2 Drawing Sheets

CLOTHES WASHING MACHINE WITH WATER RECOVERY RESERVOIR AND IMPROVED WASHING CYCLE

BACKGROUND OF THE INVENTION

The present invention refers to a clothes washing machine, in particular of the household type, provided with an improved operating method for the use of a reservoir arranged to recover liquor being discharged from the washing tub of said machine.

For convenience in describing the invention, the following description will refer to a front-loading type washing machine provided with a recovery reservoir arranged vertically against the rear panel thereof. It shall, however, be appreciated that the present invention may advantageously apply to other types of clothes washing machines, such as washing machines of the top-loading type and/or with the recovery reservoir arranged in any other possible position within or in relation to the machine. For instance, such a recovery reservoir can be arranged underneath the washing tub so as to eliminate a pump for transferring the liquor from the tub into the recovery reservoir, since the liquor will flow from one vessel into the other by gravity. Alternatively, such a recovery reservoir may be arranged in any appropriate position above the washing tub. For the same reason, a pump that would otherwise be required to transfer the liquor from the reservoir into the tub can be eliminated.

Washing machines are already known in the art that are provided with one or several reservoirs arranged to contain liquid substances to be used in the different phases of the washing program. These machines are also provided with a further reservoir arranged to recover the liquor used during the rinsing phases, in particular during the last rinsing phases, in view of using it again in the washing phase of a subsequent washing program.

The advantages of such a type of washing machine are extensively described in various prior patents, such as for instance the European patent application no. 91104057 and the Italian patent application no. PN94A000021, both filed by this same applicant, as well as the U.S. Pat. No. 2,931,199. The advantages are mainly due to the considerable saving effects that can be obtained in the usage of fresh mains water, since this is used more than once as process liquor in subsequent washing programs, without any need arising for the provision of a further apparatus to act as a recovery reservoir and without any need arising for having such an apparatus installed immediately near the clothes washing machine to which it is associated.

The continuous reduction in the usage of water in washing programs has caused the water level in the drum of the clothes washing machines to gradually be lowered down to very low values, thereby affecting the homogeneity of the water exchange process in the clothes and, as a result, the effectiveness of the rinsing process.

In designing such clothes washing machines, it has been repeatedly observed that the provision of a recovery reservoir enables a number of further useful functions to be implemented at an insignificant additional cost. Such functions add to the value of the machine as far as its water saving merits are concerned without any significant penalty as far as operation or process time requirements are concerned. In other words, it has been observed that, according to known prior-art solutions, the recovery reservoir is being used to collect and hold the liquor being discharged from one or more rinsing phases. Then, in a subsequent washing program, such liquor collected and held in the recovery reservoir is again delivered into the washing tub of the machine for reuse along with any necessary addition of fresh water from the mains, in the washing phase to be performed.

From the short description given above, it is apparent that, after being emptied, the reservoir is unused from the moment in which the washing phase is started until the moment the reservoir is filled again with rinsing liquor, preferably with liquor discharged from the last rinse. Therefore, such a reservoir is unused and empty throughout a large portion of the entire washing process.

SUMMARY OF THE INVENTION

The availability of such a recovery reservoir standing unused and empty most of the time, along with the uneven manner in which the clothes are soaked by the relatively small amount of water in the rinse bath, enables an additional use for such a reservoir during the afore cited non-use period. An appropriate sequence of transfers of the rinsing bath from the tub to the reservoir, and vice-versa, are performed while using spin-extraction to recover and eliminate the liquor retained by the clothes.

Such bath transfers are triggered and carried out during the rinsing phases, the liquor is temporarily transferred into the reservoir so as to enable the tub to be emptied. A high-speed spin-extraction and discharge phase is then carried out simultaneously in view of removing and letting off the remaining liquor retained by the clothes. The remaining liquor has a concentration of detergent which is greater than the concentration of the corresponding free-floating liquor just transferred into the reservoir. Finally, the liquor is again transferred from the reservoir into the tub.

The advantage of such an operational method derives from the fact that it is actually possible to eliminate a quantitatively modest fraction of washing liquor, which however contains a significant portion of the detergent used in the process. By eliminating such a portion of liquor retained by the clothes, the average dilution of the so clarified rinsing liquor is enhanced, thereby achieving the ultimate result that either the same rinsing effect can actually be obtained with a reduced amount of fresh water or a better rinsing effect can be obtained with the same amount of water, as anyone skilled in the art will be able to readily appreciate and as it has been extensively demonstrated experimentally.

It would therefore be desirable, and it is actually a main purpose of the present invention, to provide a clothes washing machine that is capable of performing the afore cited additional functions through the implementation of simple, low-cost improvements and the utilization of readily available techniques.

BRIEF DESCRIPTION OF THE DRAWINGS

The invention will be more readily understood from the description which is given below by way of non-limiting example with reference to the accompanying drawings, in which.

DETAILED DESCRIPTION OF THE PREFERRED EMBODIMENTS

The general term "liquor" or "water", will be used in the following description to indistinctly mean washing liquor and rinsing water. However, such a simplification will not affect the full and clear understandability of the same description, considering the context in which such terms are used, as anyone skilled in the art will readily appreciate.

Figure 1:
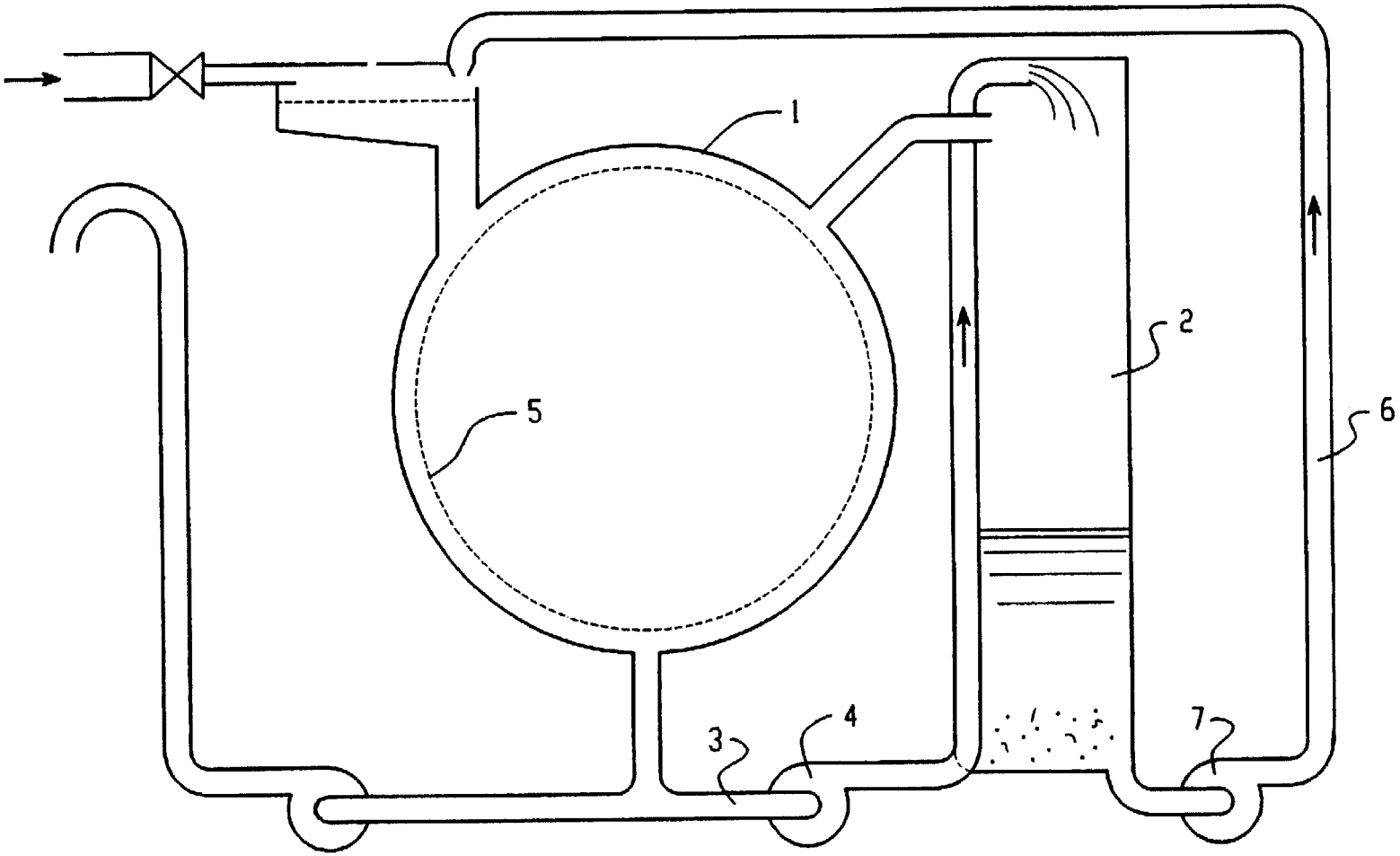
FIG. 1 is a schematic view of the water-carrying circuit of a clothes washing machine according to the present invention.

Referring to FIG. 1, which illustrates a preferred embodiment of the present invention, a structure according to the present invention will be explained along with the operating principle thereof.

The herein described clothes washing machine comprises a washing tub 1, a liquor collecting and recovery reservoir 2 arranged inside said machine, a drum 5 rotatably arranged within said washing tub and adapted to hold the clothes forming the washload, two conduits 3 and 6 provided to transfer the liquor from the tub into the reservoir and vice-versa, respectively, and corresponding transfer pumps 4, 7 associated thereto.

The washing machine is further provided with all other means which are required to ensure a correct operation thereof, but which are not specifically described here, since they are known in the art.

Figure 2:
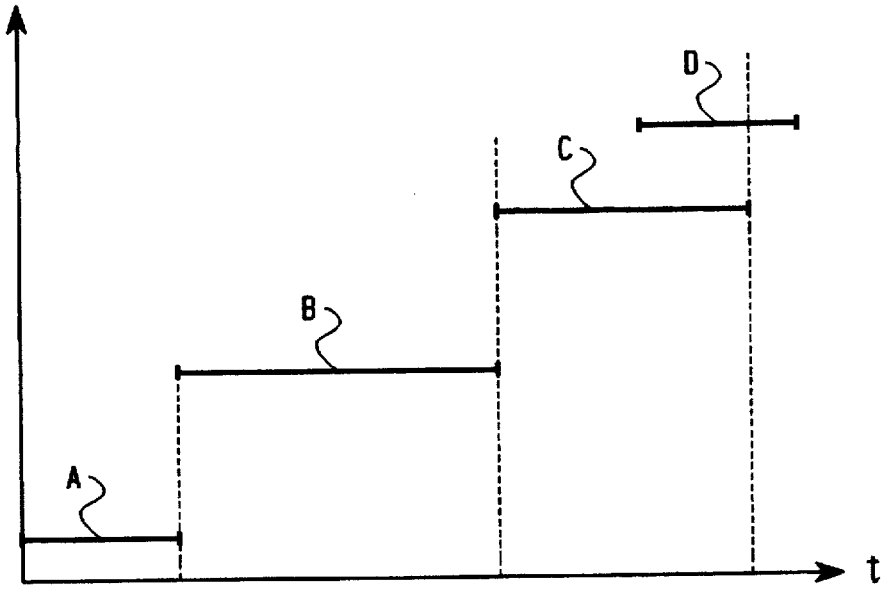
FIG. 2 is a timing diagram of the sequence of a rinsing phase as carried out in a typical prior-art clothes washing machine.

With reference to FIG. 2, it can be observed that a typical rinsing phase includes a number of elementary subphases. In a sub-phase A, water is let into the tub. In a sub-phase B, the drum is driven to rotate at low speed, this sub-phase being accompanied by water additions as required to restore the level of water in the tub. In a sub-phase C, the liquor is emptied from the tub. A spin-extraction sub-phase D is at least partly carried out jointly with the final portion of said water-discharge sub-phase C.

Figure 3:
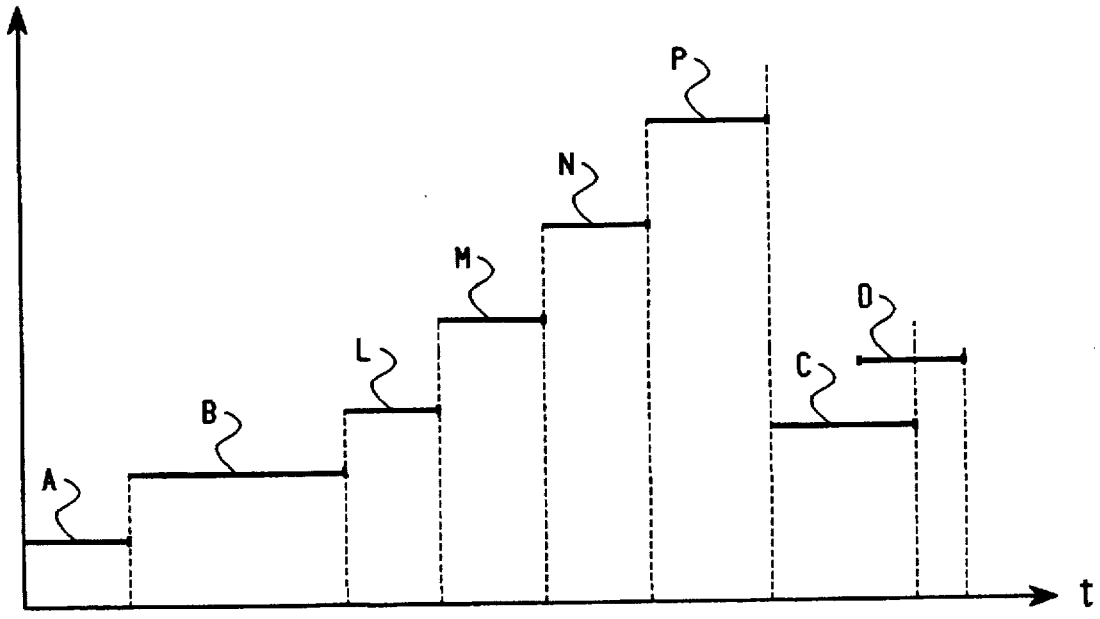
FIG. 3 is a timing diagram of the sequence of a rinsing phase as carried out in a clothes washing machine according to the present invention.

Referring now to FIG. 3, such a general rinsing phase is modified to the extent that an additional sequence of successive sub-phases is included therein. The additional sub-phases include:

- a first sub-phase L in which liquor is transferred from the tub into the reservoir,
- another spin-extraction sub-phase M accompanied by the operation of the discharge pump,
- a third sub-phase N in which liquor is transferred in the opposite direction, that is, from the reservoir into the tub, and
- a fourth sub-phase P in which the drum is driven to rotate at low speed.

An additional sequence of sub-phases L, M, N, P occurs between the low-speed rotation sub-phase B and the water outlet sub-phase C and leaves the afore cited main rinsing sub-phases A, B, C and D fully unchanged.

During a rinsing phase, especially if it is carried out with too small an amount of water, the soaking of the clothes by the water occurs in an uneven manner, depending on the various layers of the washload. The soaking particularly tends to favor the outer layers of the washload, since the penetration of the water gets increasingly more difficult as it gradually moves toward the inner layers, which therefore are generally rinsed in a poorer manner.

Generally, therefore, the average detergent concentration in the free rinsing bath, or liquor, is smaller than the detergent concentration in the liquor retained by the clothes. For this reason, if a large portion of such a liquor retained by the clothes is eliminated, that is, emptied from the machine, the rinsing action of the rinsing bath is enhanced, since said rinsing bath is not polluted by that portion of liquor with the highest detergent concentration that is actually retained by the clothes. This can be accomplished by the afore cited method, that is, with the inclusion of operational steps provided to empty the tub, spin the washload in view of extracting and removing that portion of liquor with the highest detergent concentration that is retained by the clothes, and finally restore the rinsing bath in the tub.

Such an inclusion of said additional sequence of sub-phases L, M, N, P has the effect of eliminating a quantitatively modest fraction of washing liquor, which, as has already been stressed above, contains however a significant portion of the detergent used in the process. In other words, by eliminating said portion of liquor retained by the clothes, the average dilution of the rinsing bath is clearly enhanced.

The reservoir is used to store said rinsing bath in view of re-using it for a second rinsing sub-phase. The reservoir is already available and is otherwise unused until the end of the last rinse. Two distinct rinsing phases are carried out with each rinsing water fill, thereby achieving readily appreciable advantages, although the water of the second rinsing bath will not be as clean as the water just taken in from the mains.

However, it has been extensively demonstrated experimentally that there is a very distinct advantage to be obtained, in terms of either water saving effect or, alternatively, improved overall washing effect, with a washing machine operating according to the afore described method.

The present invention can advantageously be applied in any different manner as it appears to be most appropriate according to the actual characteristics of the machine, the purposes that are actually pursued, and the penalties that can reasonably be accepted in view of obtaining the desired results, in particular, the operation time requirements of the machine.

A first improvement can for instance be achieved by implementing the afore described method not only in connection with a general rinsing cycle, but also in connection with all of the rinsing cycles provided or included in a program, thereby effectively doubling the number of the rinsing phases that are carried out actually.

Another improvement, which is aimed at minimizing any additional increase in time requirements, uses the afore described method in connection with the last rinse only. In the last rinse, the rinsing liquor, being at the end of the rinsing process, is already cleaner, so that the second rinsing sub-phase uses a liquor which is almost as clean as regular fresh water from the mains.

A further improvement is offered by the very nature of the invention itself. Considering that the latter provides for a particular process to be included within a rinsing cycle, a plurality of such processes can be used, as arranged in any appropriate sequence, within a same rinsing phase, in view of achieving any particularly desired result. It will of course be appreciated that such processes can in fact be variously arranged and combined within the individual rinsing phases so as to obtain special benefits or advantages, whereas these results are fully verifiable experimentally by anyone skilled in the art.

Various situations are possible as far as the utilization of the liquor stored in said reservoir is concerned. The most common use arises from the fact that, owing to a number of reasons, the amount of water stored in the reservoir is not sufficient to cope with the requirements connected with the washload handling phase for which it has been previously recovered. Too great an amount of water is removed during spin-extraction and, therefore, too little recovered liquor is returned into the tub.

In order to compensate for such a drawback, some known and easily implementable expedients can advantageously be provided so that, after the liquor is transferred from the reservoir into the tub, a pre-defined level thereof is restored in the same tub through a commonly known water-level restoring sequence based on additions of fresh water from the mains. As an alternative thereto, it is possible for fresh water from the mains to be initially let into the tub up to a pre-defined level, before completely emptying the reservoir by transferring into the tub the liquor contained therein.

Finally, a particular sequence ensures an optimum rinsing effect combined with a significant reduction in water usage, corresponding more or less to the amount of water requested for a rinsing bath, with a generally acceptable increase in time requirements. According to such a particular sequence, the whole rinsing cycle includes a plurality of individual rinsing phases. Within each of such individual rinsing phases, a second rinse using the same liquor according to the sub-phases L, M, N, P is carried out, which is similar to the afore described one in connection with the present invention. Furthermore, at the end of the penultimate rinsing phase, the liquor is discharged into the reservoir, instead of being drained to sewage. Immediately thereupon, the drum is driven to rotate at high speed for removal of the liquor retained by the clothes, which is therefore let off to sewage.

In the last rinsing phase, fresh water is taken in from the mains and filled into the tub up to a predetermined level. Then the filling of the tub is completed by taking in the liquor in the reservoir until the latter is fully emptied.

Finally, the usual low-speed rotation period of the drum is performed, at the end of which the liquor is transferred into the reservoir, instead of being drained outside the machine. The liquor may then be taken in from said reservoir for re-use as washing liquor in the washing phase of a subsequent washing program. This last portion of the process, however, is already known as prior-art, so that it shall not be claimed as a part of this invention.

It will be appreciated that it is within the ability of anyone skilled in the art to find further technical and optimizing solutions in the use of the afore cited reservoir, and the component parts associated thereto, by having resort to readily available techniques and usual skills. As a consequence, although the present invention has been described using a generally known terminology, it should by no means be regarded as being limited by the examples given in the above description, since anyone skilled in the art is able to bring any appropriate modification and variation thereto. The appended claims shall therefore be understood as extending to cover all such modifications that are within the abilities of those skilled in the art and fall within the actual scope of the present invention.

We claim:

1. A method of rinsing clothes in a clothes washing machine, the clothes washing machine having a washing tub (1), a drum (5) rotatably arranged within said tub and adapted to hold the washload, a liquor recovery reservoir (2), a liquor transfer conduit (3) connecting a lower portion of said washing tub with the inner volume of said reservoir, a second conduit (6) connecting the inner volume of said reservoir with the inner volume of said washing tub, and a pump (7) provided in said second conduit, said machine being adapted to perform, during a regular washing program, at least one washing phase followed by a plurality of general rinsing phases, and being also adapted to perform, at pre-settable times, spin extraction phases at a high revolution speed of the drum, the method characterized in that during any one of the general rinsing phases, a second rinse process is integrated in said general rinsing phase and comprising the steps of:

transferring substantially all removable rinsing liquor from the tub to said reservoir, spinning the drum holding the washload at the high revolution speed to extract liquor from the washload, draining, and discharging from the machine, the liquor extracted from the washload during said high-speed spinning of the drum, and returning the liquor stored in said reservoir to the tub.

2. The method according to claim 1, characterized in that the general rinsing phases comprise the steps of filling the tub with water, rotating the drum at a low revolution speed, discharging the liquor from the tub, and spinning the drum to extract liquor from the washload, wherein said second rinse process is performed immediately at the end of the rotating step of the general rinse phase.

3. The method according to claim 2, characterized in that each general rinsing phase includes the second rinse process.

4. The method according to claim 2, characterized in that the machine is adapted to perform said second rinse process more than once within a single general rinsing phase.

5. The method according to claim 2, further comprising the step of filling the tub with fresh water to a predetermined level before performing the step of returning the liquor stored in the reservoir to the tub.

6. The method according to claim 5, further comprising the steps of:

discharging the rinsing liquor from the tub to the reservoir at the end of the penultimate general rinsing phase, rotating the drum at the high revolution speed to extract liquor from the washload and discharging the extracted liquor outside the machine, filling the tub for the last general rinsing phase with fresh water to a predetermined level, and returning the liquor stored in the reservoir to the tub.

7. The method according to claim 2, further comprising the step of filling the tub with fresh water to a predetermined level after performing the step of returning the liquor stored in the reservoir to the tub.

8. The method according to claim 1, characterized in that only the last one of said general rinsing phases includes the second rinse process.

9. The method according to claim 1, characterized in that the machine is adapted to perform said second rinse process more than once within a single general rinsing phase.

10. The method according to claim 9, further comprising the step of filling the tub with fresh water to a predetermined level before performing the step of returning the liquor stored in the reservoir to the tub.

11. The method according to claim 10, further comprising the steps of:

discharging the rinsing liquor from the tub to the reservoir at the end of the penultimate general rinsing phase, rotating the drum at the high revolution speed to extract liquor from the washload and discharging the extracted liquor outside the machine, filling the tub for the last general rinsing phase with fresh water to a predetermined level, and returning the liquor stored in the reservoir to the tub.

12. The method according to claim 9, further comprising the step of filling the tub with fresh water to a predetermined level after performing the step of returning the liquor stored in the reservoir to the tub.

13. The method according to claim 1, further comprising the step of filling the tub with fresh water to a predetermined level before performing the step of returning the liquor stored in the reservoir to the tub.

14. The method according to claim 13, further comprising the steps of:

discharging the rinsing liquor from the tub to the reservoir at the end of the penultimate general rinsing phase, rotating the drum at the high revolution speed to extract liquor from the washload and discharging the extracted liquor outside the machine, filling the tub for the last general rinsing phase with fresh water to a predetermined level, and returning the liquor stored in the reservoir to the tub.

15. The method according to claim 1, further comprising the step of filling the tub with fresh water to a predetermined level after performing the step of returning the liquor stored in the reservoir to the tub.

* * * * *